US009793644B2

(12) United States Patent
Fujii

(10) Patent No.: US 9,793,644 B2
(45) Date of Patent: Oct. 17, 2017

(54) WATERPROOF CONNECTOR AND ELECTRONIC EQUIPMENT

(71) Applicant: EX COMPANY LIMITED, Matsuyama-shi, Ehime (JP)

(72) Inventor: Kazushi Fujii, Matsuyama (JP)

(73) Assignee: EX Company Limited, Matsuyama-shi (JP)

( * ) Notice: Subject to any disclaimer, the term of this patent is extended or adjusted under 35 U.S.C. 154(b) by 0 days.

(21) Appl. No.: 15/329,892

(22) PCT Filed: May 17, 2016

(86) PCT No.: PCT/JP2016/002414
§ 371 (c)(1),
(2) Date: Jan. 27, 2017

(87) PCT Pub. No.: WO2017/017873
PCT Pub. Date: Feb. 2, 2017

(65) Prior Publication Data

US 2017/0271809 A1 Sep. 21, 2017

(30) Foreign Application Priority Data

Jul. 29, 2015 (JP) ..... 2015-149917

(51) Int. Cl.
*H01R 13/52* (2006.01)
*H01R 12/70* (2011.01)
(Continued)

(52) U.S. Cl.
CPC ..... *H01R 13/5202* (2013.01); *H01R 12/7082* (2013.01); *H01R 13/6581* (2013.01);
(Continued)

(58) Field of Classification Search
CPC ..... H01R 13/5202
See application file for complete search history.

(56) References Cited

U.S. PATENT DOCUMENTS 5,888,083 A * 3/1999 Seilhan ..... H01R 13/523 439/161
7,922,535 B1 * 4/2011 Jiang ..... H01R 13/5205 439/271

(Continued)

FOREIGN PATENT DOCUMENTS

JP 2541155 B2 10/1996
JP 2000-156263 A 6/2000

(Continued)

OTHER PUBLICATIONS

Patent Opposition dated Aug. 4, 2017, issued in counterpart Japanese Application No. 2017-700656. (3 pages).

*Primary Examiner* — James Harvey
(74) *Attorney, Agent, or Firm* — Westerman, Hattori, Daniels & Adrian, LLP

(57) ABSTRACT

A waterproof connector (1) includes: a first shell (2) having an approximately tubular form, formed of metal and disposed on a plug insertion side; a second shell (3) having an approximately tubular form, formed of metal and engaged with a rear portion of the first shell (2); an outer sealing member (4) provided on an outer circumference of the first shell (2) so as to abut on a front surface portion (31) of the second shell (3) positioned on an outer side of the first shell (2); a supporting portion (5) accommodated in a wall form in a rear portion of an engagement assembly of the first shell (2) and the second shell (3) in a state in which water does not enter toward a rear side from a space between the engagement assembly and the supporting portion; and contact terminals (6) supported by the supporting portion (5). At least one of the first shell (2) and the second shell (3) is seamless. In this way, it is possible to provide a waterproof connector having a low manufacturing cost and excellent manufacturing efficiency, capable of securing a waterproof performance, decreasing the length of the connector, improving the strength of the shell, and eliminating the need of a resin housing for preventing entrance of water.

20 Claims, 6 Drawing Sheets

(51) Int. Cl.

| | |
|---|---|
| ***H01R 24/64*** | (2011.01) |
| ***H01R 13/6581*** | (2011.01) |
| ***H01R 13/6593*** | (2011.01) |
| *H01R 107/00* | (2006.01) |

(52) U.S. Cl.
CPC ..... *H01R 13/6593* (2013.01); *H01R 24/64* (2013.01); *H01R 2107/00* (2013.01)

(56) References Cited

U.S. PATENT DOCUMENTS

| | | | | |
|---|---|---|---|---|
| 9,634,425 | B1 * | 4/2017 | Hsu | H01R 13/5202 |
| 2014/0315439 | A1 * | 10/2014 | Zhang | H01R 13/516<br>439/626 |
| 2015/0280356 | A1 * | 10/2015 | Jove Albos | H01R 13/504<br>439/587 |
| 2016/0020549 | A1 * | 1/2016 | Chen | H01R 13/5202<br>439/78 |
| 2016/0149337 | A1 | 5/2016 | Ozaki et al. | |
| 2017/0162975 | A1 * | 6/2017 | Tsai | H01R 13/5202 |

FOREIGN PATENT DOCUMENTS

| | | | |
|---|---|---|---|
| JP | 2005-302362 | | 10/2005 |
| JP | 2009-176734 | A | 8/2009 |
| JP | 2012-9357 | A | 1/2012 |
| JP | 2012-59556 | A | 3/2012 |
| JP | 2012-113989 | A | 6/2012 |
| JP | 2015-5383 | A | 1/2015 |

* cited by examiner (a)

(b)

(a)

(b)

(a)

(b)

WATERPROOF CONNECTOR AND ELECTRONIC EQUIPMENT

TECHNICAL FIELD

The present invention relates to a connector used for electrical connection of various types of electronic equipment such as multifunctional mobile phones, multifunctional mobile information terminals or mobile audio players. More specifically, the present invention relates to a waterproof connector having a waterproof function and electronic equipment.

BACKGROUND ART

Conventionally, Patent Literature 1 discloses a waterproof connector as an example of a waterproof connector for electronic equipment having a waterproof function. The shell of this waterproof connector is formed by pressing a metal plate to form a plate member, rolling the pressing member, and bonding both ends so as to fit with each other whereby a bonding seam extending over an entire length in a plug insertion direction is formed. A rear end of the shell is fitted and attached to a front end of a resin housing, a sealing member on the outer circumference of the resin housing blocks water entering the outer side of the shell, and the resin housing blocks water entering the inner side of the shell.

Patent Literature 2 discloses a waterproof connector capable of reducing the length thereof to decrease the area occupied by the connector and increasing the strength of a shell while securing a waterproof performance. The waterproof connector disclosed in Patent Literature 2 includes a seamless approximately tubular shell, a supporting portion accommodated in a wall form in the shell, contact terminals supported by the supporting portion, and a sealing member provided on an outer circumference of the shell. Since the supporting portion that supports the contact terminals are accommodated in the seamless shell, the length of the connector is decreased while securing a waterproof performance. Furthermore, since the seamless shell having no seam is used, it is not necessary to provide a resin housing in order to increase the strength of the shell to prevent water from entering through a seam.

PRIOR ART LITERATURE

Patent Literature

Patent Literature 1: Japanese Patent Application Publication No. 2009-176734

Patent Literature 2: Japanese Patent Application Publication No. 2015-5383

SUMMARY OF INVENTION

Problem to be Solved by Invention

The waterproof connector disclosed in Patent Literature 2 has an advantage that it is possible to secure a waterproof performance, reduce the length of the connector, improve the strength of the shell, and eliminate the need to provide the resin housing for preventing water from entering through a seam. However, the waterproof connector has a disadvantage that, since processing of a high degree of difficulty is required to form an entire shell of a waterproof connector seamlessly, manufacturing efficiency decreases and the manufacturing cost increases. Due to this, it is necessary to provide a waterproof connector having excellent manufacturing efficiency at a low cost while having the advantage of securing a waterproof performance, reducing the length of the connector, improving the shell strength, and eliminating the need of a resin housing for preventing entrance of water.

The present invention has been suggested in view of the afore-mentioned problem. An object of the present invention is to provide a waterproof connector having excellent manufacturing efficiency at a low cost and capable of securing a waterproof performance, reducing the length of the connector, improving shell strength, and eliminating the need of a resin housing for preventing entrance of water and electronic equipment having the waterproof connector.

Means of Solving Problem

A waterproof connector according to the present invention includes: a first shell having an approximately tubular form, formed of a conductive material and disposed on a plug insertion side; a second shell having an approximately tubular form, formed of a conductive material and engaged with the first shell; an outer sealing member provided on an outer circumference of the first shell and positioned on an outer side of the first shell; a supporting portion accommodated in a wall form in a rear portion of an engagement assembly of the first shell and the second shell in a state in which water does not enter toward a rear side from a space between the engagement assembly and the supporting portion; and contact terminals supported by the supporting portion, wherein at least one of the first shell and the second shell is seamless.

According to this configuration, the outer sealing member provided on the outer circumference of the first shell blocks water entering the outer side of the first shell, and the supporting portion accommodated in the engagement assembly of the first and second shells in a state in which water does not enter toward the rear side blocks water entering the inner side of the first shell. In this way, it is possible to secure a waterproof performance. Moreover, since the supporting portion is accommodated in the rear portion of the engagement assembly of the first and second shells, it is possible to reduce the length of the connector, increase an available area inside the electronic equipment to thereby provide more freedom in the internal layout design of the electronic equipment and to achieve a reduction in the size of the electronic equipment. Moreover, since at least one of the first shell and the second shell is seamless, it is possible to improve the strength and the durability of the shell. Furthermore, since at least one of the first shell and the second shell is seamless, it is possible to secure a waterproof performance without using a resin housing for preventing entrance of water and to decrease the thickness of the connector by eliminating the need of the resin housing for preventing entrance of water. Furthermore, the length of the first and second shells can be reduced as compared to when the entire shell is formed of a single member, and it is possible to eliminate the need to perform complex processing on a portion corresponding to an engagement portion of the engagement assembly. Therefore, it is possible to reduce the manufacturing cost of the waterproof connector and to improve the manufacturing efficiency.

In the waterproof connector of the present invention, the second shell is engaged with a rear portion of the first shell, and the outer sealing member abuts on a front surface portion of the second shell.

According to this configuration, since at least one of the first shell and the second shell is seamless on the rear side of the outer sealing member, it is possible to secure a waterproof performance while eliminating the need of a resin housing for preventing entrance of water and to reduce the thickness of the connector as compared to when the resin housing for preventing entrance of water is used.

The waterproof connector of the present invention includes: an inner sealing member having a circumferential form, provided between the engagement assembly and the supporting portion at a position at which the engagement assembly and the supporting portion approach each other so as to prevent water from passing between the engagement assembly and the supporting portion.

According to this configuration, the inner sealing member having the circumferential form prevents water from passing between the engagement assembly and the supporting portion to thereby secure a waterproof performance. Therefore, it is not necessary to provide a filling material in the space on the deep side of the engagement assembly of the shells so as to be firmly fixed to the inner surface of the engagement assembly. Moreover, it is possible to prevent the filling material from peeling off the inner surface of the engagement assembly by the force applied intermittently to form a gap to thereby deteriorate the waterproof performance. Moreover, since the inner sealing member having the circumferential form is disposed so as to be sandwiched between the engagement assembly and the supporting portion, it is possible to reliably prevent water from entering into the deep side of the engagement assembly from the space between the engagement assembly and the supporting portion accommodated therein with high stability and durability. Furthermore, since a space for filling the filling material on the deep side of the engagement assembly is not necessary, it is possible to further decrease the length of the waterproof connector to reduce the size thereof.

In the waterproof connector of the present invention, the first shell is seamless.

According to this configuration, since the first shell in which strong load and stress are likely to be applied is seamless when the plug inserted in the connector is pried out strongly or the prying force is applied several times, it is possible to remarkably increase the strength and the durability of the shell.

In the waterproof connector of the present invention, both the first shell and the second shell are seamless.

According to this configuration, it is possible to combine the first seamless shell having high strength and the second seamless shell having high strength and to remarkably increase the strength and the durability of the entire shell. Moreover, since both the first and second shells are seamless, it is possible to secure a waterproof performance regardless of the position of the outer sealing member in a plug insertion direction.

In the waterproof connector of the present invention, a connection piece is formed integrally with the second shell for connection to a circuit board.

According to this configuration, the engagement assembly of the first and second shells can be connected to the circuit board without using a separate connection member. Moreover, the connection piece can be formed integrally with the second shell which has a smaller length than when the entire seamless shell is formed of a single member and which is a separate member from the first shell regardless of the shape of the first shell. Therefore, processing can be performed more remarkably easily than when the connection piece is formed on a seamless shell which is entirely formed of a single member. For example, when the second shell is seamless, the second shell in which the connection piece is integrally formed can be formed easily by draw-pressing. Moreover, when the second shell has a seam, the second shell in which the connection piece is integrally formed can be formed very easily by press punching and bending.

In the waterproof connector of the present invention, a stopper piece for the supporting portion is formed integrally with the second shell.

According to this configuration, it is possible to prevent the supporting portion from being removed by the second shell without using a separate stopper member. Moreover, the stopper piece can be formed integrally with the second shell which has a smaller length than when the entire seamless shell is formed of a single member and which is a separate member from the first shell regardless of the shape of the first shell. Therefore, processing can be performed more remarkably easily than when the stopper piece is formed on a seamless shell which is entirely formed of a single member. For example, when the second shell is seamless, the second shell in which the stopper piece is integrally formed can be formed easily by draw-pressing. Moreover, when the second shell has a seam, the second shell in which the stopper piece is integrally formed can be formed very easily by press punching and bending.

In the waterproof connector of the present invention, the first shell is seamless, the second shell has a shape having a seam, and the connection piece or the stopper piece is formed or both of them are formed integrally with the second shell.

According to this configuration, since the first shell in which strong load and stress are likely to be applied is seamless when the plug inserted in the connector is pried out strongly or the prying force is applied several times, it is possible to remarkably increase the strength and the durability of the shell. Moreover, when the second shell has a shape having a seam and the connection piece or the stopper piece is formed, or both of them are formed integrally with the second shell, the connection piece or the stopper piece, or both can be formed very easily and with a high degree of freedom in shape by press punching and bending.

In the waterproof connector of the present invention, the first shell has a seamless simply tubular form, or a seamless simply tubular form in which a flange portion is formed in a rear end so as to protrude toward an outer side.

According to this configuration, it is possible to form the first shell very easily by draw-pressing. Therefore, it is possible to further decrease the manufacturing cost and to further improve the manufacturing efficiency.

In the waterproof connector of the present invention, the first shell has an approximately tubular form in which a flange portion is formed in a rear end so as to protrude toward an outer side, and the flange portion is engaged with a front end or a rear end of the second shell.

According to this configuration, it is possible to insert the second shell from the plug insertion side of the first shell to easily engage and attach the second shell to the first shell and to improve the manufacturing efficiency.

In the waterproof connector of the present invention, the second shell is seamless, and a small-diameter tubular portion on a front side of the second shell is fitted to an inner side of the rear portion of the first shell.

According to this configuration, it is possible to fit the small-diameter tubular portion of the second seamless shell to the inner side of the rear portion of the first shell from the opposite side from the plug insertion side to easily engage and attach the second shell to the first shell and to improve the manufacturing efficiency. Moreover, it is possible to provide a waterproof function reliably with the second shell regardless of whether the first shell is seamless.

Electronic equipment according to the present invention includes the waterproof connector according to the present invention accommodated in a case, wherein the outer sealing member is press-fitted directly or indirectly to the case to form a watertight structure.

According to this configuration, it is possible to obtain electronic equipment having the advantages of the waterproof connector according to the present invention, capable of reliably preventing water from entering toward the circuit board side of the electronic equipment from a space between the waterproof connector and the case.

Advantageous Effects of Invention

According to the present invention, it is possible to secure a waterproof performance, reduce the length of the connector, improve shell strength, eliminate the need of a resin housing for preventing entrance of water, decrease the manufacturing cost of the waterproof connector, and improve the manufacturing efficiency.

EMBODIMENTS FOR CARRYING OUT INVENTION

[Waterproof Connector of First Embodiment]

A waterproof connector 1 according to a first embodiment of the present invention is used for mobile electronic equipment such as multifunctional mobile phones, multifunctional mobile information terminals or mobile audio players.

Figure 1:
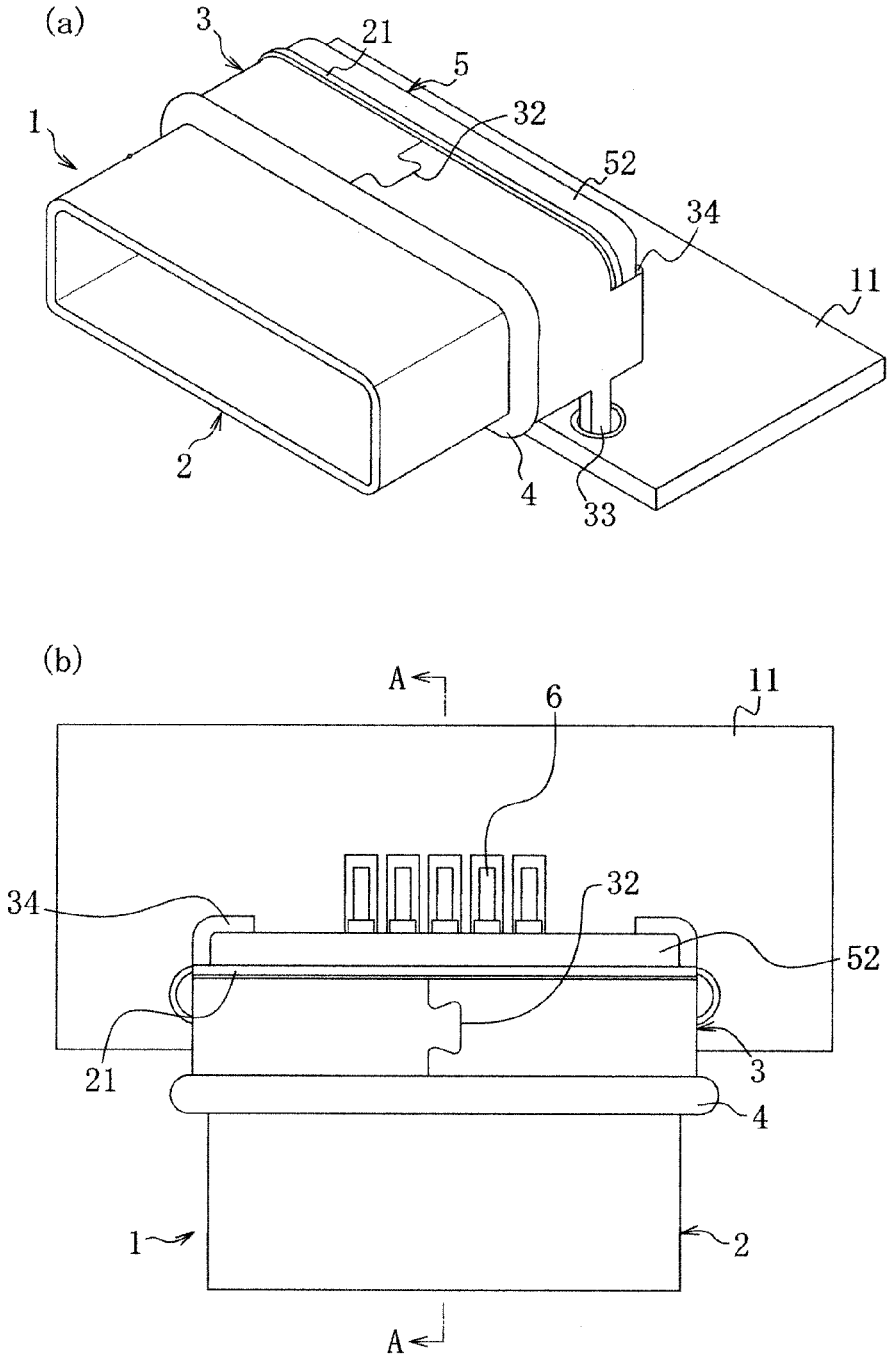
FIG. 1(*a*) is a perspective view of a waterproof connector and a circuit board according to a first embodiment of the present invention and FIG. 1(*b*) is a plan view thereof.
Figure 2:
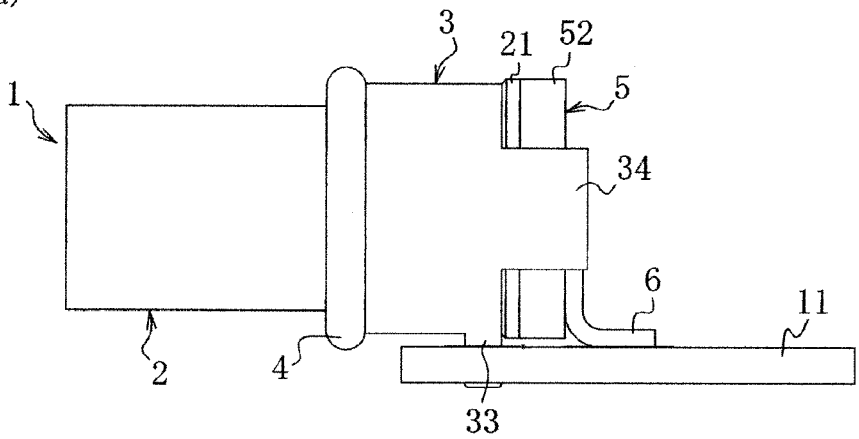
FIG. 2(*a*) is a side view of the waterproof connector and the circuit board according to the first embodiment and FIG. 2(*b*) is a sectional view taken along line A-A.
Figure 2:
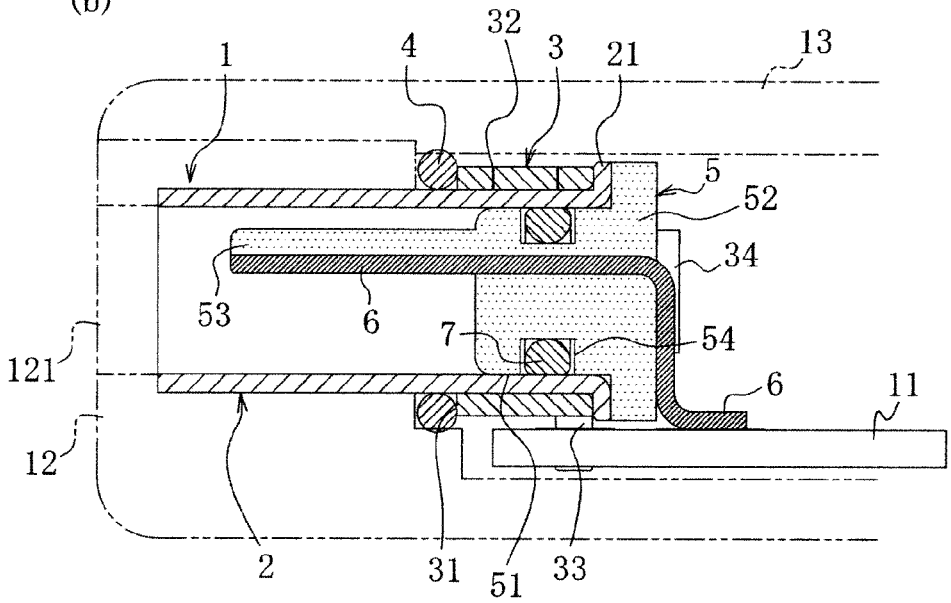

As illustrated in FIGS. 1 and 2, the waterproof connector of the first embodiment includes a first shell 2 having an approximately tubular form, formed of metal which is a conductive material and disposed on a plug insertion side, a second shell 3 having an approximately tubular form, formed of metal which is a conductive material so as to be engaged with a rear portion of the first shell 2, an outer sealing member 4 provided on an outer circumference of the first shell 2 so as to abut on a front surface portion 31 of the second shell 3, positioned on the outer side of the first shell 2, a supporting portion 5 accommodated in a wall form in a rear portion of an engagement assembly of the first and second shells 2 and 3 in a state in which water does not enter toward the rear side from a space between the supporting portion 5 and the engagement assembly, and contact terminals 6 supported by the supporting portion 5. The waterproof connector 1 is accommodated in and attached to a case of the electronic equipment.

The first shell 2 is formed, for example, by subjecting a metal flat plate to draw-pressing and has an approximately seamless rectangular tubular form having no seam. A flange portion 21 that protrudes outward is formed in a circumferential form on a rear end of the first shell 2. Both side portions of the flange portion 21 at positions corresponding to a stopper piece 34 to be described later are notched. Moreover, the second shell 3 is formed, for example, by subjecting a metal flat plate to press punching and bending, and has an approximately rectangular tubular form which is not seamless and has a bonding seam 32 extending over an entire length in an axial direction. The second shell 3 has a shape corresponding to the shape of the first shell 2 and has such a size that the second shell 3 can be fitted to the outer circumference of the first shell 2. The second shell 3 is disposed so that the second shell 3 is fitted from a plug insertion side of the first shell 2 and a rear end thereof abuts on and engages with the flange portion 21.

Connection pieces 33 for connection to a circuit board 11 are integrally formed on both side portions of the second shell 3 by subjecting a metal flat plate to press punching and bending, for example, and the connection piece 33 extends downward. The second shell 3 engaged with the first shell 2 is electrically connectable to the first shell 2, and the engagement assembly of the first and second shells 2 and 3 is connected to the ground by being connected to the circuit board 11 of the connection piece 33.

Stopper pieces 34 for the supporting portion 5 are integrally formed on both side portions of the second shell 3 by subjecting a metal flat plate to press punching and bending, for example, and the stopper piece 34 is formed so as to extend backward and be bent inward. The stopper piece 34 is configured to retain the supporting portion 5 accommodated in the first shell 3 to be described later or the engagement assembly of the first and second shells 2 and 3 so that the supporting portion 5 is not removed outside. The stopper piece 34 is formed by bending a distal end thereof inward after the supporting portion 5 is accommodated, and the stopper piece 34 substantially abuts on the rear surface of the supporting portion 5.

The outer sealing member 4 is configured as an O-ring and is disposed to abut on the front surface portion 31 of the second shell 3 inserted to the outer side of the first shell 2 in a circumferential form. In the present embodiment, the outer sealing member 4 is formed in an approximately intermediate region in a longitudinal direction of the first shell 2.

The outer sealing member 4 can be formed of an appropriate material having a waterproof function and a sealing property. In addition to the O-ring, the outer sealing member 4 may include a body having an approximately rectangular cross-section, formed of a soft resin such as elastomer in an approximately rectangular frame-shaped ring form and a protruding strip having an approximately ridge-shaped cross-section, protruding outward from the body. Alternatively, the outer sealing member 4 may be formed of a water repellent material. Moreover, when the outer sealing member 4 is formed of a water repellent material, a gap may be formed between a water repellent material such as a coating layer of a water repellent agent and a case-side member such as a case of electronic equipment so that the water repellent material does not abut on the case-side member.

The outer sealing member 4 abuts so as to be pressed to a bottom case 12 and a top case 13 that form the case of electronic equipment, for example, whereby a watertight structure which prevent water from passing between the waterproof connector 1 and the case is formed. In FIG. 2, a plug insertion opening 121 is formed in a side wall of the bottom case 12 in the illustrated example.

The watertight structure may be formed so that the outer sealing member 4 is fitted to a groove of the bottom case 12 and a groove of the top case 13. Moreover, the watertight structure may be formed so that the outer sealing member 4 is directly pressed to the case. In addition to this, the watertight structure may be formed so that the outer sealing member 4 is indirectly pressed to the case in such a way that the outer sealing member 4 abuts so as to be pressed to a seal receiving member such as rubber formed in the bottom case 12 or the top case 13, or both.

The supporting portion 5 is formed of an insulating hard resin and is provided in a wall form so as to block the deep side of the first shell 2 and is accommodated in a wall form in a state in which water does not enter toward the rear side from the space between the first shell 2 and the supporting portion 5. That is, the supporting portion 5 is accommodated in a wall form in the rear portion of the engagement assembly of the first and second shells 2 and 3 in a state in which water does not enter toward the rear side from the space between the engagement assembly and the supporting portion 5. In the present embodiment, a small diameter portion 51 of the supporting portion 5 is inserted to the first shell 2 from the opposite side of the plug insertion side and a large diameter portion 52 is fitted to abut on the flange portion 21.

The contact terminals 6 are partially buried in the supporting portion 5 by insert molding and are attached to the supporting portion 5 by insert molding so as to form a watertight structure. The contact terminals 6 are arranged to follow a protruding portion 53 protruding toward the front side of the supporting portion 5 and are introduced into the first shell 2. The contact terminals 6 are exposed in the first shell 2 so that the contact terminals 6 can make conductive contact with plug-side contacts. Moreover, the contact terminals 6 are pulled from the rear side of the small diameter portion 51 and the large diameter portion 52 and are connected to the circuit board 11.

An inner sealing member 7 having a circumferential form, preventing water from passing between the space between the engagement assembly or the first shell 2 and the supporting portion 5 is provided between the supporting portion 5 and the engagement assembly at a position at which the supporting portion 5 approaches the engagement assembly of the first and second shells 2 and 3. In the present embodiment, the inner sealing member 7 is provided between the first shell 2 and the supporting portion 5 or the small diameter portion 51 at which the first shell 2 and the supporting portion 5 approach each other.

The inner sealing member 7 is fitted to a recess 54 having a circumferential form formed in the outer circumference of the small diameter portion 51 of the supporting portion 5. The inner sealing member 7 has a circumferential form having an approximately circular cross-section and can be configured as an O-ring formed of an elastic material such as rubber or a soft resin.

The inner sealing member 7 is provided so that a portion thereof protrudes outward from a portion of the outer circumferential surface of the small diameter portion 51 of the supporting portion 5 in a state before the supporting portion 5 is accommodated in the first shell 2. Moreover, the small diameter portion 51 of the supporting portion 5 is press-fitted to the first shell 2 so as to crush the protruding portion of the inner sealing member 7, and the inner sealing member 7 is pressure-contacted to the inner surface of the first shell 2 in a circumferential form.

According to the first embodiment, the outer sealing member 4 provided on the outer circumference of the first shell 2 blocks water entering the outer side of the first shell 2, and the supporting portion 5 accommodated in the engagement assembly of the first and second shells 2 and 3 in a state in which water does not enter toward the rear side blocks water entering the inner side of the first shell 2. In this way, it is possible to secure a waterproof performance. Moreover, since the supporting portion 5 is accommodated in the rear portion of the engagement assembly of the first and second shells 2 and 3, it is possible to reduce the length of the connector, increase an available area inside the electronic equipment to thereby provide more freedom in the internal layout design of the electronic equipment and to achieve a reduction in the size of the electronic equipment.

Since the first shell 2 in which strong load and stress are likely to be applied is seamless when the plug inserted in the connector is pried out strongly or the prying force is applied several times, it is possible to remarkably increase the strength and the durability of the shell. Moreover, since the first shell 2 is seamless on the rear side of the outer sealing member 4, it is possible to secure a waterproof performance while eliminating the need of a resin housing for preventing entrance of water and to reduce the thickness of the connector as compared to when the resin housing for preventing entrance of water is used.

The length of the first and second shells 2 and 3 can be reduced as compared to when the entire shell is formed of a single member, and it is possible to eliminate the need to perform complex processing on a portion corresponding to an engagement portion of the engagement assembly. Therefore, it is possible to reduce the manufacturing cost of the waterproof connector 1 and to improve the manufacturing efficiency.

The inner sealing member 7 having the circumferential form prevents water from passing between the engagement assembly and the supporting portion 5 to thereby secure a waterproof performance. Therefore, it is not necessary to provide a filling material in the space on the deep side of the engagement assembly of the shells so as to be firmly fixed to the inner surface of the engagement assembly. Moreover, it is possible to prevent the filling material from peeling off the inner surface of the engagement assembly by the force applied intermittently to form a gap to thereby deteriorate the waterproof performance. Moreover, since the inner sealing member 7 having the circumferential form is disposed so as to be sandwiched between the engagement assembly and the supporting portion 5, it is possible to reliably prevent water from entering into the deep side of the engagement assembly from the space between the engagement assembly and the supporting portion 5 accommodated therein with high stability and durability. Furthermore, since a space for filling the filling material on the deep side of the engagement assembly is not necessary, it is possible to further decrease the length of the waterproof connector 1 to reduce the size thereof.

The engagement assembly of the first and second shells 2 and 3 can be connected to the circuit board 11 by the connection pieces 33 of the second shell 3 without using a separate connection member. Moreover, the connection pieces 33 can be formed integrally with the second shell 3 which has a smaller length than when the entire seamless shell is formed of a single member and which is a separate member from the first shell 2 regardless of the shape of the first shell 2. Therefore, processing can be performed more remarkably easily than when the connection pieces are formed on a seamless shell which is entirely formed of a single member. Particularly, the second shell 3 has a seam. In the present embodiment, the second shell 3 in which the connection pieces 33 are integrally formed can be formed very easily and with a high degree of freedom in shape by press punching and bending.

The stopper pieces 33 of the second shell 3 can prevent the supporting portion 5 from being removed by the second shell 2 without using a separate stopper member. The stopper pieces 34 can be formed integrally with the second shell 3 which has a smaller length than when the entire seamless shell is formed of a single member and which is a separate member from the first shell 2 regardless of the shape of the first shell 2. Therefore, processing can be performed more remarkably easily than when the stopper pieces are formed on a seamless shell which is entirely formed of a single member. Particularly, the second shell 2 has a seam. In the present embodiment, the second shell 3 in which the stopper pieces 34 are integrally formed can be formed very easily and with a high degree of freedom in shape by press punching and bending.

Due to the flange portion 21 of the first shell 2, the second shell 2 can be externally inserted from the plug insertion side of the first shell 2 and the second shell 3 can be brought into abutting contact with the first shell 1. Therefore, it is possible to easily engage and attach the shells and to improve the manufacturing efficiency. Moreover, it is possible to further increase the strength and the durability of the shell in a stacking region of the first and second shells 2 and 3.

[Waterproof Connector of Second Embodiment]

Figure 3:
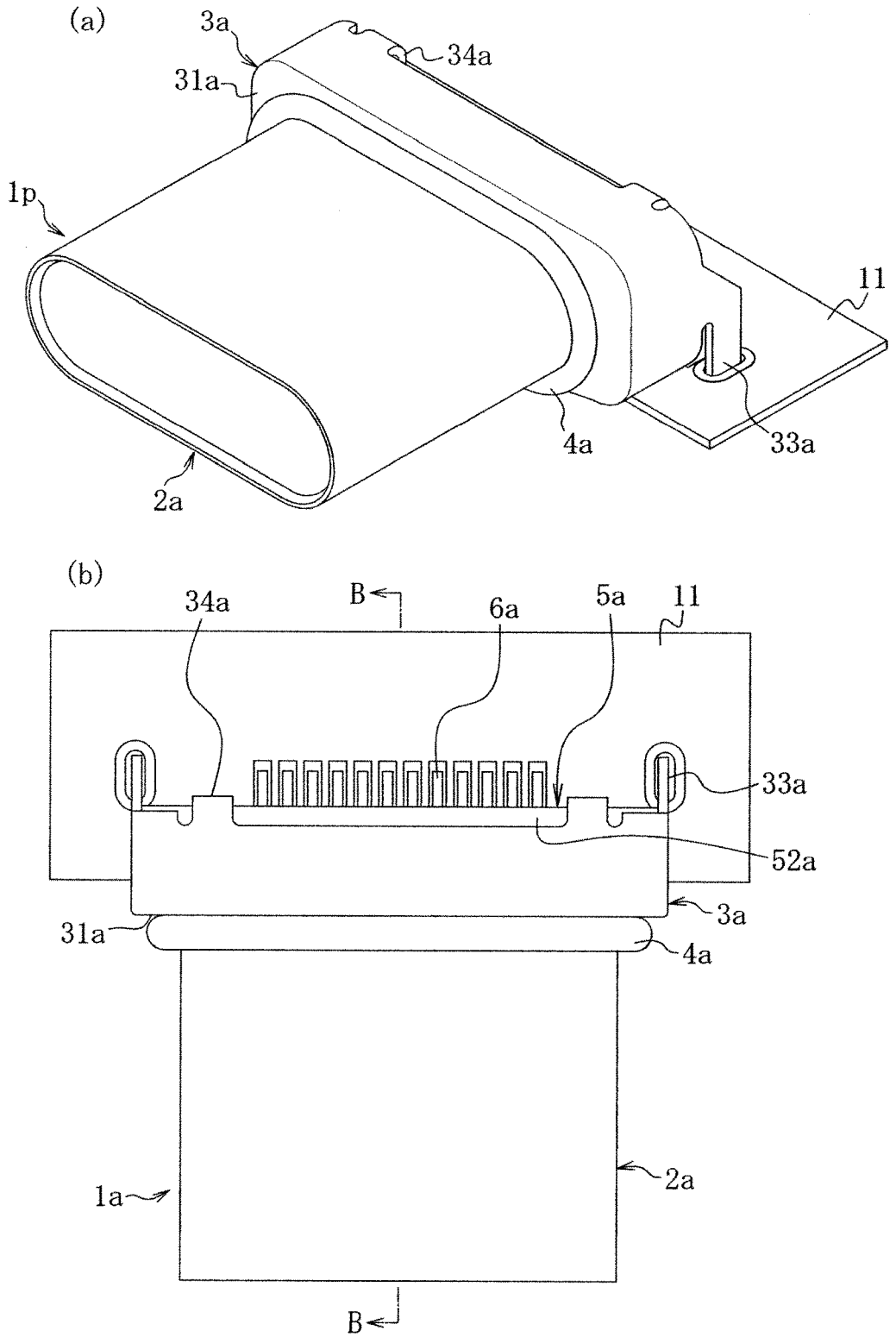
FIG. 3(*a*) is a perspective view of a waterproof connector and a circuit board according to a second embodiment of the present invention and FIG. 3(*b*) is a plan view thereof.
Figure 4:
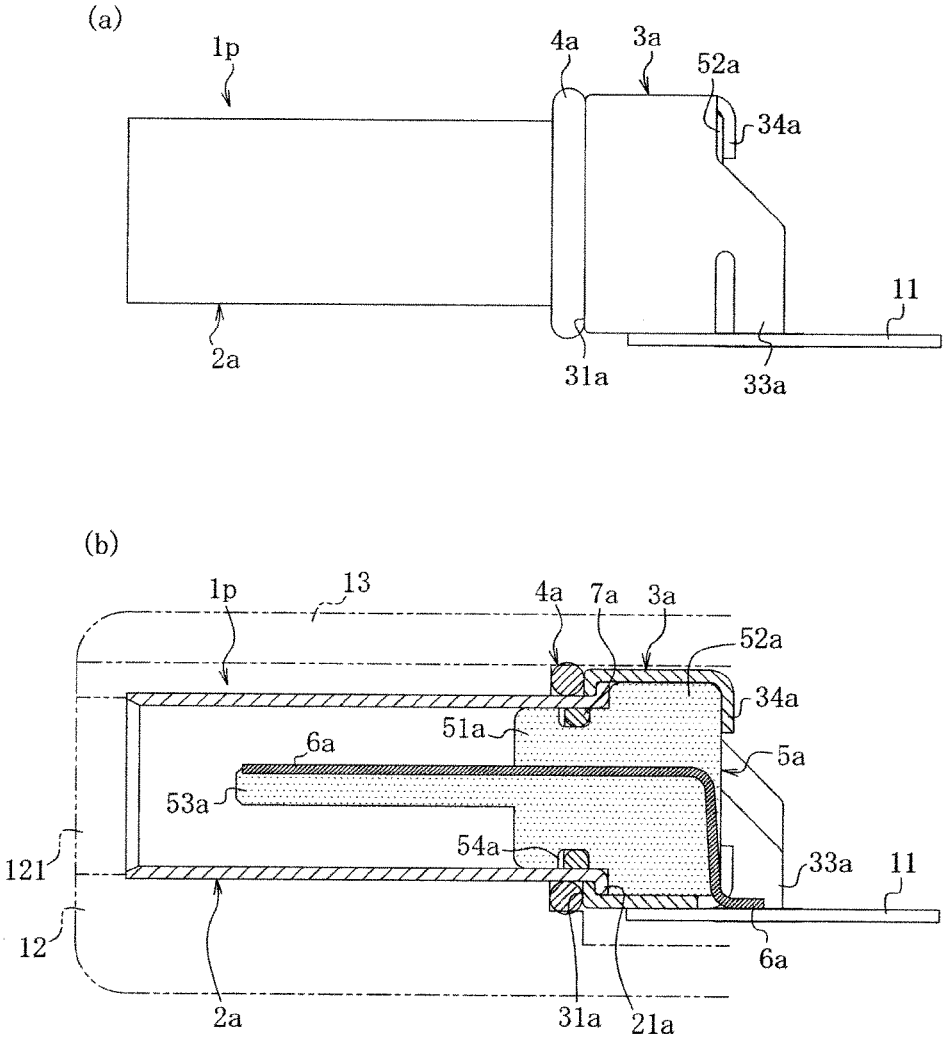
FIG. 4(*a*) is a side view of the waterproof connector and the circuit board according to the second embodiment and FIG. 4(*b*) is a sectional view taken along line B-B.

A waterproof connector 1*p* according to a second embodiment of the present invention is also used for mobile electronic equipment such as multifunctional mobile phones, multifunctional mobile information terminals or mobile audio players. As illustrated in FIGS. 3 and 4, the waterproof connector 1*p* includes a first shell 2*a* having an approximately tubular form, formed of metal which is a conductive material and disposed on a plug insertion side, a second shell 3*a* having an approximately tubular form, formed of metal which is a conductive material so as to be engaged with a rear portion of the first shell 2*a*, an outer sealing member 4*a* provided on an outer circumference of the first shell 2*a* so as to abut on a front surface portion 31*a* of the second shell 3*a*, positioned on the outer side of the first shell 2*a*, a supporting portion 5*a* accommodated in a wall form in a rear portion of an engagement assembly of the first and second shells 2*a* and 3*a* in a state in which water does not enter toward the rear side from a space between the supporting portion 5*a* and the engagement assembly, and contact terminals 6*a* supported by the supporting portion 5*a*. The waterproof connector 1*p* is accommodated in and attached to a case of the electronic equipment.

The first shell 2*a* is formed, for example, by subjecting a metal flat plate to draw-pressing and has a seamless simple elliptical tubular form having no seam. A flange portion 21*a* that protrudes outward is formed in a circumferential form on a rear end of the first shell 2*a*. Moreover, the second shell 3*a* is formed, for example, by subjecting a metal flat plate to draw-pressing, punching or chopping unnecessary portions, and bending necessary portions and has an approximately seamless elliptical tubular form having no seam.

The second shell 3*a* has a shape corresponding to the shape of a large diameter portion 52*a* of the supporting portion 5*a*, and an opening of a front surface portion 31*a* formed in a front end of the second shell 3*a* has a shape corresponding to an outer shape of the first shell 2*a* and a size corresponding to the outer shape of the first shell 2*a*. The second shell 3*a* is disposed so that the second shell 3*a* is fitted to the outer side from a plug insertion side of the first shell 2*a* and a rear surface side of the front surface portion 31*a* at the front end thereof abuts on and engages with the flange portion 21*a*.

Connection pieces 33*a* for connection to a circuit board 11 are integrally formed on both side portions of the second shell 3*a*, and the connection piece 33 extends downward. The second shell 3*a* engaged with the first shell 2*a* is electrically connectable to the first shell 2*a*, and the engagement assembly of the first and second shells 2*a* and 3*a* is connected to the ground by being connected to the circuit board 11 of the connection piece 33*a*.

Stopper pieces 34*a* for the supporting portion 5*a* are integrally formed on the rear end of the upper surface of the second shell 3*a*, and the pair of stopper pieces 34 is formed so as to extend backward and be bent downward. The stopper piece 34*a* is formed by bending a distal end thereof downward after the supporting portion 5*a* is accommodated, and the stopper piece 34*a* substantially abuts on the rear surface of the supporting portion 5*a*.

The outer sealing member 4*a* is configured as an O-ring. The outer sealing member 4*a* is disposed so that the rear end thereof abuts on the front surface portion 31*a* of the second shell 3*a* engaged with the flange portion 21*a* of the first shell 2*a* in a circumferential form. In the present embodiment, the outer sealing member 4*a* is disposed in a region approximately close to the rear portion in the longitudinal direction of the first shell 2*a*. The outer sealing member 4*a* can be formed and configured using an appropriate material similarly to the outer sealing member 4 of the first embodiment. Moreover, the outer sealing member 4*a* abuts so as to be pressed to a case including the bottom case 12 and the top case 13 to form a watertight structure similarly to the first embodiment.

The supporting portion 5*a* is formed of an insulating hard resin and is provided in a wall form so as to block the deep side of the first shell 2*a* and is accommodated in a wall form in a state in which water does not enter toward the rear side from the space between the first shell 2*a* and the supporting portion 5*a*. That is, the supporting portion 5*a* is accommodated in a wall form in the rear portion of the engagement assembly of the first and second shells 2*a* and 3*a* in a state in which water does not enter toward the rear side from the space between the engagement assembly and the supporting portion 5*a*. In the present embodiment, a small diameter portion 51*a* of the supporting portion 5*a* is inserted to the first shell 2*a* from the opposite side of the plug insertion side and a large diameter portion 52*a* is fitted to abut on the flange portion 21*a*.

The contact terminals 6*a* are partially buried in the supporting portion 5*a* by insert molding and are attached to the supporting portion 5*a* by insert molding so as to form a watertight structure. The contact terminals 6*a* are arranged to follow a protruding portion 53*a* protruding toward the front side of the supporting portion 5*a* and are introduced into the first shell 2*a*. The contact terminals 6*a* are exposed in the first shell 2*a* so that the contact terminals 6*a* can make conductive contact with plug-side contacts. Moreover, the contact terminals 6*a* are pulled from the rear side of the small diameter portion 51*a* and the large diameter portion 52*a* and are connected to the circuit board 11.

An inner sealing member 7*a* having a circumferential form, preventing water from passing between the space between the engagement assembly or the first shell 2*a* and the supporting portion 5*a* is provided between the supporting portion 5 and the engagement assembly at a position at which the supporting portion 5*a* approaches the engagement assembly of the first and second shells 2*a* and 3*a*. In the present embodiment, the inner sealing member 7*a* is provided between the first shell 2*a* and the supporting portion 5*a* or the small diameter portion 51*a* at which the first shell 2*a* and the supporting portion 5*a* approach each other.

The inner sealing member 7*a* is fitted to a recess 54*a* having a circumferential form formed in the outer circumference of the small diameter portion 51*a* of the supporting portion 5*a*. The inner sealing member 7*a* has a circumferential form having an approximately circular cross-section and can be configured as an O-ring formed of an elastic material such as rubber or a soft resin.

The inner sealing member 7*a* is provided so that a portion thereof protrudes outward from a portion of the outer circumferential surface of the small diameter portion 51*a* of the supporting portion 5*a* in a state before the supporting portion 5*a* is accommodated in the first shell 2*a*. Moreover, the small diameter portion 51*a* of the supporting portion 5*a* is press-fitted to the first shell 2*a* so as to crush the protruding portion of the inner sealing member 7*a*, and the inner sealing member 7*a* is pressure-contacted to the inner surface of the first shell 2*a* in a circumferential form.

According to the second embodiment, it is possible to obtain corresponding advantages based on the configuration corresponding to the first embodiment. Moreover, since both the first and second shells 2*a* and 3*a* are seamless, it is possible to further improve the strength and the durability of the entire shell. Furthermore, since the first shell 2*a* has a shape that the flange portion 21*a* is formed in the rear end having a simple tubular form, it is possible to very easily form the first shell 2*a* by draw-pressing, further reduce the manufacturing cost, and further improve the manufacturing efficiency. Furthermore, since both the first and second shells 2*a* and 3*a* are seamless, it is possible to secure a waterproof performance regardless of the position of the outer sealing member 4*a* in a plug insertion direction.

[Waterproof Connector of Third Embodiment]

Figure 5:
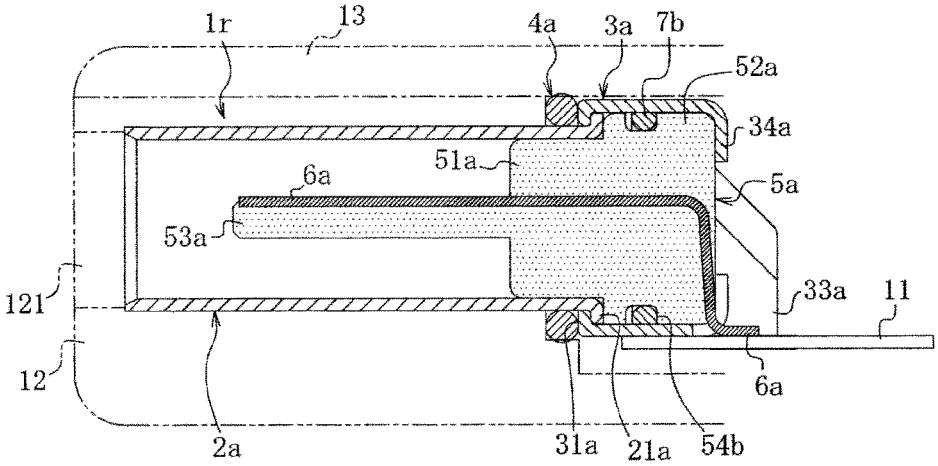
FIG. 5 is a sectional view corresponding to the sectional view taken along line B-B, of a waterproof connector and a circuit board according to a third embodiment of the present invention.

A waterproof connector 1*r* according to a third embodiment of the present invention is a modification of the waterproof connector 1*p* of the second embodiment. As illustrated in FIG. 5, the position at which an inner sealing member 7*b* is provided is different from the second embodiment. That is, when the inner sealing member 7*b* is provided between the engagement assembly and the supporting portion 5*a* at a position at which the engagement assembly of the first and second shells 2*a* and 3*a* approaches the supporting portion 5*a*, the inner sealing member 7*b* having a circumferential form, configured to prevent water from passing between the engagement assembly or the second shell 3*a* and the supporting portion 5*a* is provided between the second shell 3*a* and the large diameter portion 52*a* of the supporting portion 5*a*.

The inner sealing member 7*b* is provided to be fitted to a recess 54*b* having a circumferential form, formed in the outer circumference of the large diameter portion 51*a* of the supporting portion 5*a*. The inner sealing member 7*b* has a circumferential form having an approximately circular cross-section and can be formed as an O-ring formed of an elastic material such as rubber or a soft resin. In the present embodiment, since the second shell 3*a* that covers the circumference of the large diameter portion 52*a* of the supporting portion 5*a* on the rear side of the outer sealing member 4*a* is seamless, it is possible to provide a waterproof function even when the inner sealing member 7*b* is pressed to the second shell 3*a* at the position of the large diameter portion 52*a*.

The inner sealing member 7*b* is provided so that in a state before assembling, a portion of the inner sealing member 7*b* protrudes outward from a portion of the outer circumferential surface of the large diameter portion 51*b* of the supporting portion 5*a*. Moreover, the small diameter portion 51*a* of the supporting portion 5*a* is inserted and fitted to the first shell 2*a* from the opposite side from the plug insertion side, the second shell 3*a* in which the stopper piece 34*a* is not bent is fitted from the plug insertion side, and the second shell 3*a* is fitted so as to crush the protruding portion of the inner sealing member 7*b*. In this way, the inner sealing member 7*b* is pressure-contacted to the inner surface of the second shell 3*a* in a circumferential form.

The other configuration is the same as that of the second embodiment, and the third embodiment provides the same advantages as the second embodiment.

[Waterproof Connector of Fourth Embodiment]

Figure 6:
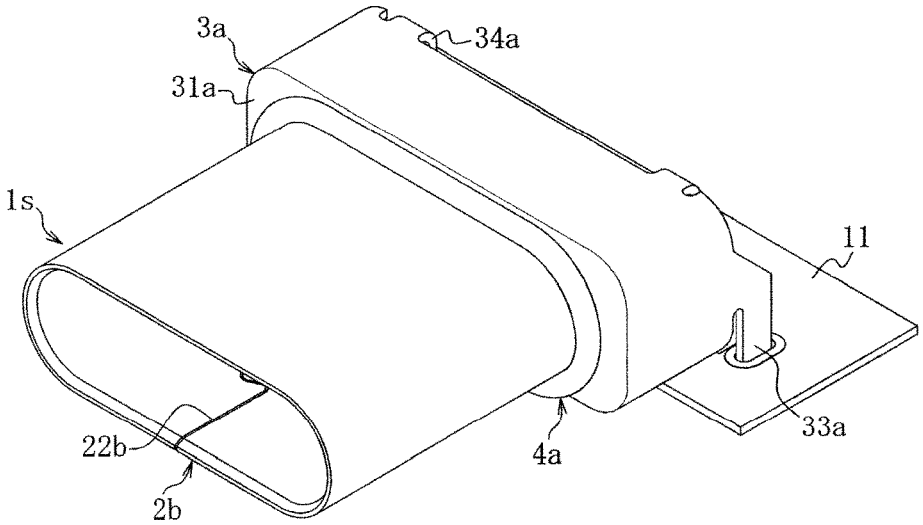
FIG. 6(*a*) is a perspective view of a waterproof connector and a circuit board according to a fourth embodiment of the present invention, FIG. 6(*b*) is a sectional view corresponding to the sectional view taken along line B-B.
Figure 6:
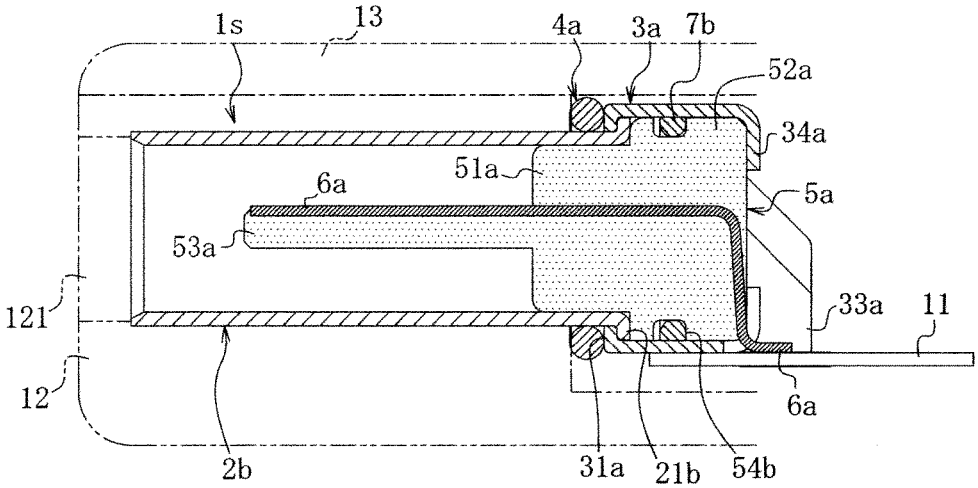

A waterproof connector is according to a fourth embodiment of the present invention is a modification of the waterproof connector 1*r* of the third embodiment. As illustrated in FIG. 6, a first shell 2*b* having a seam 22*b* extending over the entire length in an axial direction is used instead of the first seamless shell 2*a*. The first shell 2*b* has a simple elliptical tubular form similarly to the first shell 2*a*, and a flange portion 21*b* that protrudes outward from a rear end of the first shell 2*b* is formed in a circumferential form.

In the present embodiment, the second shell 3*a* that covers the circumference of the large diameter portion 52*a* of the supporting portion 5*a* on the rear side of the outer sealing member 4*a* is seamless and the inner sealing member 7*b* is pressed to the second seamless shell 3*a* to provide a waterproof function. Therefore, a waterproof performance is secured even when the first shell 2*b* has the seam 22*b*. In the electronic equipment, since the first shell 2*b* has the seam 22*b*, the outer sealing member 4*a* is biased so as to be pressed to the second seamless shell 3*a* by the case such as the bottom case 12 of the electronic equipment in order to provide a more reliable waterproof performance.

The other configuration is the same as the third embodiment, and the fourth embodiment provides the same advantages as the third embodiment.

[Waterproof Connector of Fifth Embodiment]

Figure 7:
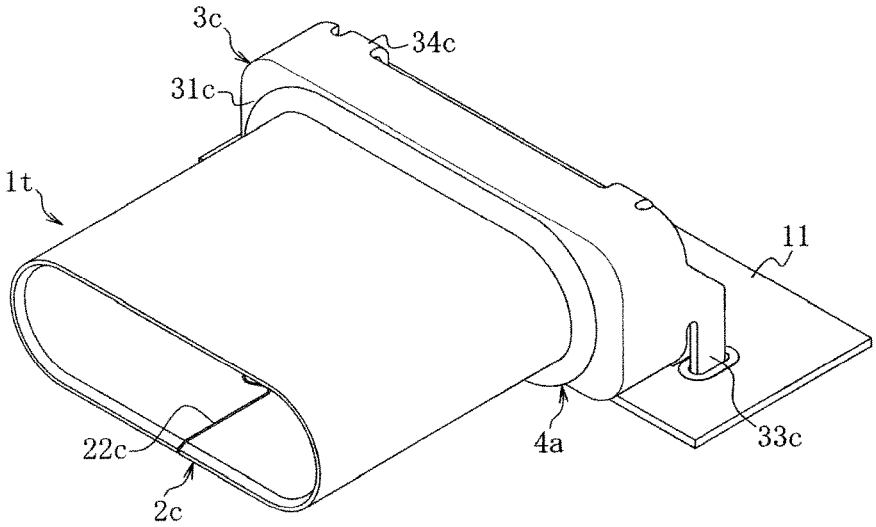
FIG. 7(*a*) is a perspective view of a waterproof connector and a circuit board according to a fifth embodiment of the present invention and FIG. 7(*b*) is a sectional view corresponding to the sectional view taken along line B-B.
Figure 7:
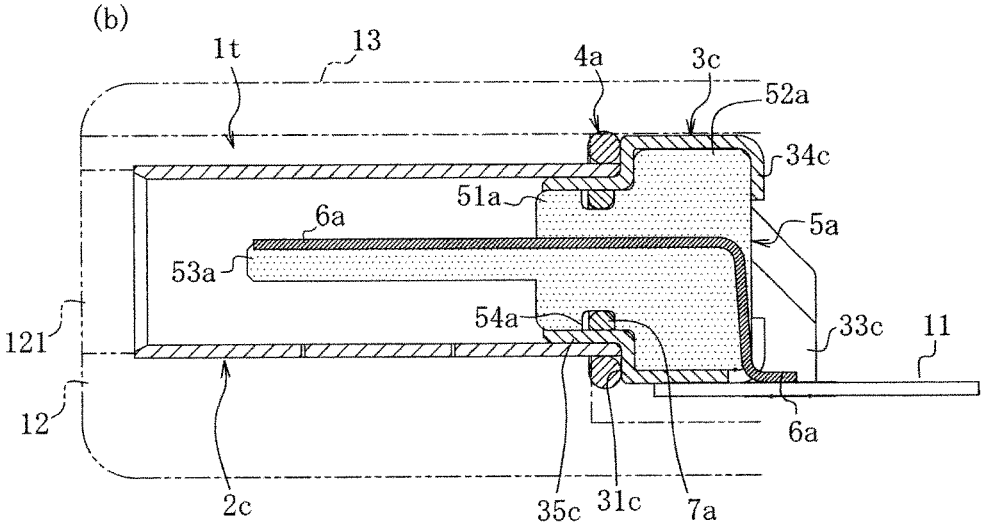

A waterproof connector 1*t* according to a fifth embodiment of the present invention is a modification of the waterproof connector 1*p* of the second embodiment. As illustrated in FIG. 7, a first shell 2*c* having an approximately tubular form, formed of metal which is a conductive material and disposed on the plug insertion side and a second shell 3*c* having an approximately tubular form, formed of metal which is a conductive material and engaged with a rear portion of the first shell 2*c* are different from those of the second embodiment. The configurations of the outer sealing member 4*a*, the supporting portion 5*a*, the contact terminals 6*a*, and the inner sealing member 7*a* are the same as those of the second embodiment.

The first shell 2*c* is formed, for example, by subjecting a metal flat plate to press punching and bending and has a bonding seam 22*c* extending over the entire length in the axial direction. The first shell 2*c* is formed in a simple elliptical tubular form having no flange portion. Moreover, the second shell 3*c* is formed, for example, by subjecting a metal flat plate to draw-pressing, punching or chopping unnecessary portions, and bending necessary portions and has an approximately seamless elliptical tubular form having no seam.

The second shell 3*c* has a shape corresponding to the shape of the large diameter portion 52*a* of the supporting portion 5*a*, a front surface portion 31*c* is formed in a front end of the second shell 3*c*, and a small-diameter tubular portion 35*c* having an elliptical tubular form is formed to be bent forward from the inner side of the front surface portion 31*c*. The front surface portion 31 and the small-diameter tubular portion 35*c* are formed to follow the shape of the supporting portion 5*a*, and the inner diameter of the tubular portion 35*c* is slightly larger than that of the small diameter portion 51*a* of the supporting portion 5*a*. Moreover, the outer diameter of the small-diameter tubular portion 35*c* is slightly smaller than the inner diameter of the first shell 2*c*.

The small-diameter tubular portion 35*c* on the front side of the second shell 3*c* is inserted to the rear portion of the first shell 2*c* from the opposite side from the plug insertion side and is fitted to the inner side of the rear portion of the first shell 2*c* so as to be engaged with the first shell 2*c*. Moreover, the supporting portion 5*a* is inserted and fitted to the second shell 3*c* in which the stopper piece 34*c* is not bent, from the opposite side from the plug insertion side. The inner sealing member 7*a* protruding from the small diameter portion 51 is press-fitted to the small-diameter tubular portion 35*c* of the second shell 3*c* and is pressure-contacted in a circumferential form to the inner circumferential surface of the tubular portion 35*c*. The supporting portion 5*a* is accommodated in a wall form in a state in which water does not enter toward the rear side from the space between the engagement assembly and the supporting portion 5*a*. With this pressing based on pressure-contact, the small-diameter tubular portion 35*c* is biased toward the outer side, the engagement between the small-diameter tubular portion 35*c* of the second shell 3*c* and the rear portion of the first shell 2*c* becomes rigid, and the fitting strength increases.

The outer sealing member 4*a* is inserted and fitted to the outer circumference of the first shell 2*c* from the plug insertion side, and the outer sealing member 4*a* is disposed to approximately abut on the front surface portion 31*c* of the second shell 3*c*. Similarly to the fourth embodiment, in the electronic equipment, since the first shell 2*c* has the seam 22*c*, the outer sealing member 4*a* is biased so as to be pressed to the second seamless shell 3*c* by the case such as the bottom case 12 of the electronic equipment in order to secure the waterproof performance. Furthermore, similarly to the second embodiment, the connection pieces 33*c* for connection to the circuit board 11 are formed so as to extend downward from the second shell 3*c*, and the stopper pieces 34*c* for the supporting portion 5*a* are formed so as to extend backward and be bent downward. The other configuration is the same as the second embodiment.

The fifth embodiment provides corresponding advantages based on the configuration corresponding to the second embodiment. Moreover, by fitting the small-diameter tubular portion 35*c* of the second seamless shell 3*c* to the inner side of the rear portion of the first shell 2*c* from the opposite side from the plug insertion side, it is possible to easily engage and attach the second shell 3*c* to the first shell 2*c* and to improve the manufacturing efficiency. Moreover, it is possible to provide a waterproof function reliably with the second shell 3*c* regardless of whether the first shell 2*c* is seamless. Furthermore, it is possible to further increase the strength and the durability of the shell in a stacking region of the small-diameter tubular portion 35*c* and the first shell 2*c*.

[Modifications of Embodiments]

The invention disclosed in this specification includes, in addition to the structures according to respective inventions or embodiments, in an applicable range, a matter defined by modifying any of these partial configurations into other configurations disclosed in this specification, a matter defined by adding any other configurations disclosed in this specification to these partial configurations, or a matter defined into a generic concept by cancelling any of these partial configurations within a limit that achieves a partial operational advantage. The invention disclosed in this specification further includes the following modifications.

For example, in the above-described embodiments, the connection pieces 33, 33*a*, or 33*c* and the stopper pieces 34, 34*a*, or 34*c* are formed integrally with the second shell 3, 3*a*, or 3*c*. However, a separate member in which the connection pieces or the stopper pieces, or both are formed may be engaged with the second shell having an approximately tubular form. For example, connection pieces or stopper pieces, or both may be formed in a ring-shaped or tubular member and this member may be provided to be engaged with a flange portion or the like formed in the rear end of the second shell.

A material other than metal may be used as a conductive material for forming the first shell 2, 2*a*, or 2*c* and the second shell 3, 3*a*, or 3*c*. For example, the first shell 2, 2*a*, or 2*c* and the second shell 3, 3*a*, or 3*c* may be formed using a conductive resin.

Instead of a configuration in which the inner sealing member 7, 7*a*, or 7*b* is disposed in the recess 54, 54*a*, or 54*b*, an inner sealing member such as a bond or a double-side adhesive tape may be coated on the outer circumference of the supporting portion and be attached to the inner surface of the first or second shell. Moreover, in the present invention, instead of the inner sealing member, a recess surrounded by the supporting portion and the second shell or a recess surrounded by the first and second shells and the supporting portion may be formed on a deeper side than the supporting portion of the first and second shells as a space for filling the filling material, and the filling material may be filled in the recess so that a waterproof function is provided on the inner side of the first and second shells.

When the waterproof connector 1 is manufactured, the first shells 2, 2*a*, or 2*c* and the second shells 3, 3*a*, or 3*c* can be formed by an appropriate step other than the step described in the embodiments. For example, the first and second shells of the present invention can be formed by metal powder injection molding (MIM) or a 3D printer.

INDUSTRIAL APPLICABILITY

The present invention is applicable as a waterproof connector used for electrical connection of various types of electronic equipment such as multifunctional mobile phones, multifunctional mobile information terminals, or mobile audio players.

REFERENCE SIGNS LIST

1, 1*p*, 1*r*, 1*s*, 1*t*: Waterproof connector
2, 2*a*, 2*b*, 2*c*: First shell

21, 21*a*, 21*b*: Flange portion
22*b*, 22*c*: Seam
3, 3*a*, 3*c*: Second shell
31, 31*a*, 31*c*: Front surface portion
32: Seam
33, 33*a*, 33*c*: Connection piece
34, 34*a*, 34*c*: Stopper piece
35*c*: Small-diameter tubular portion
4, 4*a*: Outer sealing member
5, 5*a*: Supporting portion
51, 51*a*: Small diameter portion
52, 52*a*: Large diameter portion
53, 53*a*: Protruding portion
54, 54*a*, 54*b*: Recess
6, 6*a*: Contact terminal
7, 7*a*, 7*b*: Inner sealing member
11: Circuit board
12: Bottom case
121: Plug insertion opening
13: Top case

The invention claimed is:

1. A waterproof connector comprising:

a first shell having an approximately tubular form, formed of a conductive material and disposed on a plug insertion side;

a second shell having an approximately tubular form, formed of a conductive material and engaged with the first shell;

an outer sealing member provided on an outer circumference of the first shell and positioned on an outer side of the first shell;

a supporting portion accommodated in a wall form in a rear portion of an engagement assembly of the first shell and the second shell in a state in which water does not enter toward a rear side from a space between the engagement assembly and the supporting portion; and contact terminals supported by the supporting portion, wherein at least one of the first shell and the second shell is seamless.

2. The waterproof connector according to claim 1, the second shell is engaged with a rear portion of the first shell, and the outer sealing member abuts on a front surface portion of the second shell.

3. The waterproof connector according to claim 1, further comprising:

an inner sealing member having a circumferential form, provided between the engagement assembly and the supporting portion at a position at which the engagement assembly and the supporting portion approach each other so as to prevent water from passing between the engagement assembly and the supporting portion.

4. The waterproof connector according to claim 2, further comprising:

an inner sealing member having a circumferential form, provided between the engagement assembly and the supporting portion at a position at which the engagement assembly and the supporting portion approach each other so as to prevent water from passing between the engagement assembly and the supporting portion.

5. The waterproof connector according to claim 1, wherein the first shell is seamless.

6. The waterproof connector according to claim 2, wherein the first shell is seamless.

7. The waterproof connector according to claim 3, wherein the first shell is seamless.

8. The waterproof connector according to claim 4, wherein the first shell is seamless.

9. The waterproof connector according to claim 5, wherein both the first shell and the second shell are seamless.

10. The waterproof connector according to claim 6, wherein both the first shell and the second shell are seamless.

11. The waterproof connector according to claim 7, wherein both the first shell and the second shell are seamless.

12. The waterproof connector according to claim 8, wherein both the first shell and the second shell are seamless.

13. The waterproof connector according to claim 1, wherein a connection piece is formed integrally with the second shell for connection to a circuit board.

14. The waterproof connector according to claim 2, wherein a connection piece is formed integrally with the second shell for connection to a circuit board.

15. The waterproof connector according to claim 3, wherein a connection piece is formed integrally with the second shell for connection to a circuit board.

16. The waterproof connector according to claim 1, wherein a stopper piece for the supporting portion is formed integrally with the second shell.

17. The waterproof connector according to claim 2, wherein a stopper piece for the supporting portion is formed integrally with the second shell.

18. The waterproof connector according to claim 3, wherein a stopper piece for the supporting portion is formed integrally with the second shell.

19. Electronic equipment comprising the waterproof connector according to claim 1 accommodated in a case, wherein the outer sealing member is press-fitted directly or indirectly to the case to form a watertight structure.

20. Electronic equipment comprising the waterproof connector according to claim 2 accommodated in a case, wherein the outer sealing member is press-fitted directly or indirectly to the case to form a watertight structure.

* * * * *